US008714669B1

(12) United States Patent
Clausen

(10) Patent No.: US 8,714,669 B1
(45) Date of Patent: May 6, 2014

(54) STORAGE AND RETRIEVAL MACHINE WITH VARIABLE-HEIGHT DOOR OPENING

(76) Inventor: Mark Kirgiss Clausen, Milwaukee, WI (US)

( * ) Notice: Subject to any disclaimer, the term of this patent is extended or adjusted under 35 U.S.C. 154(b) by 481 days.

(21) Appl. No.: 12/970,497

(22) Filed: Dec. 16, 2010

(51) Int. Cl.
*A47B 49/00* (2006.01)

(52) U.S. Cl.
USPC ..... 312/305; 312/297; 160/37

(58) Field of Classification Search
USPC ..... 312/266, 267, 135, 305, 297, 351; 160/120, 122, 37
See application file for complete search history.

(56) References Cited

U.S. PATENT DOCUMENTS

| | | | | | |
|---|---|---|---|---|---|
| 538,430 | A * | 4/1895 | McKenzie | 160/118 |
| 1,119,702 | A * | 12/1914 | Infeld | 312/9.7 |
| 2,200,329 | A * | 5/1940 | Derman | 312/260 |
| 2,235,454 | A * | 3/1941 | Koropchak | 160/37 |
| 2,827,118 | A * | 3/1958 | Wendt | 160/184 |
| 3,807,826 | A * | 4/1974 | Peckenpaugh | 312/305 |
| 5,295,743 | A * | 3/1994 | Moulton et al. | 312/297 |
| 5,381,846 | A | 1/1995 | Lichy | |
| 5,820,237 | A * | 10/1998 | Robey | 312/268 |
| 6,003,583 | A * | 12/1999 | Lacoste et al. | 160/122 |
| 6,450,598 | B1 | 9/2002 | Hanel | |
| 6,848,491 | B2 | 2/2005 | Gambarelli | |
| 2004/0004419 | A1* | 1/2004 | Godlewski | 312/297 |
| 2004/0041500 | A1* | 3/2004 | Appino | 312/267 |

* cited by examiner

*Primary Examiner* — James O Hansen

(57) ABSTRACT

This storage and retrieval machine consists of an enclosure with an enclosure opening and two independently positionable doors, which move vertically to block or provide access into the storage machine. The enclosure contains one or more shelf stacks, where each shelf stack has multiple, easily adjustable, drawer-style shelves to form storage areas of various vertical dimensions. One may combine several shelf stacks to form a rotatable storage cylinder. Shelves used with either the fixed or rotatable shelf supports can be blocked by one or both doors to prohibit their repositioning.

13 Claims, 4 Drawing Sheets

STORAGE AND RETRIEVAL MACHINE WITH VARIABLE-HEIGHT DOOR OPENING

CROSS-REFERENCE TO RELATED APPLICATIONS

Not Applicable

FEDERALLY SPONSORED RESEARCH

Not Applicable.

SEQUENCE LISTING OR PROGRAM

Not Applicable.

BACKGROUND OF THE INVENTION

1. Field of Invention

This invention relates to a storage and retrieval machine that allows easy reconfiguration of storage areas and has doors that provide access to items of various vertical dimensions.

2. Background of the Invention

Storage machines for dispensing tools and other related material in manufacturing and repair facilities are well known. The simplest form of these machines resembles storage lockers, consisting of non-adjustable storage areas within an enclosure and secured by doors of uniform dimensions.

Another form of these machines has one or more rotating storage cylinders (e.g. sandwich machines). The storage cylinders normally consist of shelf stacks running vertically along the length of the cylinder, divided by shelves to form storage areas. The cylinder rotates until the desired stack faces toward an opening in the enclosure. Vertically stacked doors block the enclosure opening. Usually the doors are of uniform height, and one of the doors opens to provide access to a stored item located in one of the storage areas. In both forms of the machines, the vertical dimension of the storage area depends on the door height rather than the height of the stored item. In such machines, items taller than the doors cannot be stored unless multiple doors are opened.

Users of storage and retrieval machines often require differently sized storage areas. When one orders the machine, an administrator (i.e. the person who knows the mix of items to be stored) determines the mix of storage areas the machine should contain. The manufacturer uses this information to configure the machine. Therefore, the administrator must perform a careful analysis of storage needs before the machine can be manufactured. This determination may be time consuming and may result in delayed deliveries while the machine manufacturer waits for the administrator to finish the analysis. A good system would allow the administrator to configure storage areas after taking delivery of the machine using readily available tools. A better system would allow the administrator to change the configuration easily without tools. The best system would allow reconfiguration without tools and without opening the machine's enclosure.

3. Prior Art

Many inventors have developed dual doors to conceal and protect stored items (Lichy, Side Coiling Fabric Door, U.S. Pat. No. 5,381,846, Jan. 17, 1995, Gambarelli, Cover For Storage Space Affording Access to a Selected Part Thereof, U.S. Pat. No. 6,848,491 B2, Feb. 1, 2005). Others have used dual doors that move horizontally to form an opening that allows access to stored items (Hanel, Storage and Retrieval System, U.S. Pat. No. 6,450,598 B1, Sep. 17, 2002), but none has used dual doors to access items with a wide range of vertical dimensions from a storage and retrieval unit. Further, none of the prior art allows one to easily reconfigure the shelves to accommodate changes in storage requirements. This attribute is particularly important because it provides space efficient storage over the life of the storage machine.

OBJECTS AND ADVANTAGES

This storage and retrieval machine has an enclosure with doors that provide a variable height access opening for easy, secure access to a stored item. The machine allows one to access items stored at different vertical elevations and with different vertical dimensions. While a variable height opening may be valuable when used with fixed shelving, it offers further advantages when used with adjustable-height shelving.

What sets the embodiments of this application apart from the prior art is drawer-style shelves used in conjunction with upper and lower doors that can be positioned independently. The doors can be positioned to block shelf removal but still allow one to access storage areas. Therefore, a user retrieving or inserting items from/to storage areas cannot remove or rearrange the shelves. However, during restocking or reconfiguration, the administrator can position the upper and lower doors so that the shelves are not blocked, providing for easy shelf removal and repositioning. This combination of drawer style shelves and independently positionable doors allows the administrator not only to restock the machine but also to reconfigure the storage areas to maximize space utilization.

The simplest embodiment of this application consists of a machine with a fixed-positioned shelf stack mounted in an enclosure behind dual doors. When not blocked by either door, one can install or remove shelves to/from the shelf stack through an enclosure opening. One can easily reposition the drawer-style shelves with readily available tools or even without tools. This embodiment resembles a storage locker, but with variable-height shelving and vertically adjustable doors.

Another embodiment of the machine combines multiple shelf stacks to form a storage cylinder. The cylinder rotates to bring the desired shelf stack to the enclosure opening, allowing one to reposition the stack's drawer-style shelves in the same manner as described above for the fixed-position shelf stack.

DRAWINGS

Figures

Figure 1:
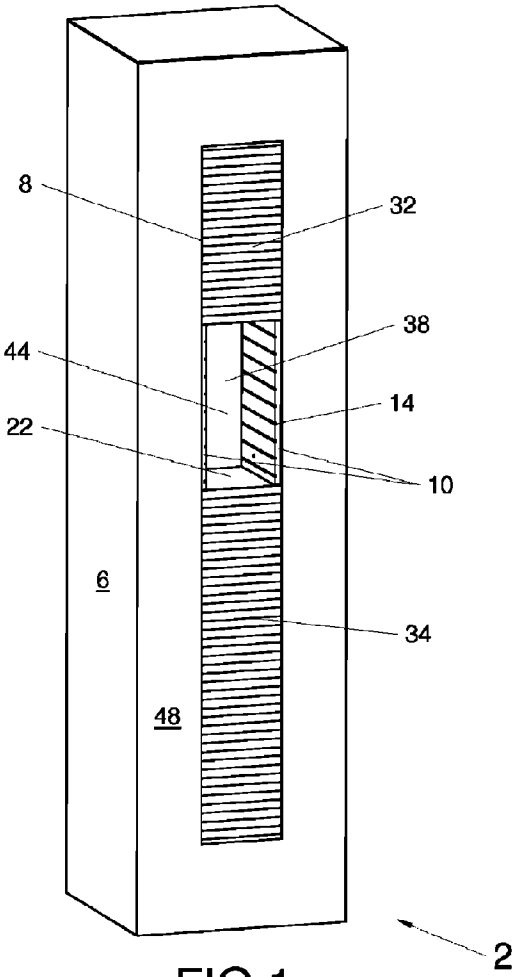
FIG. 1 shows a schematic perspective view of the storage machine with the doors in an open position allowing access to a storage area with large vertical height.
Figure 5:
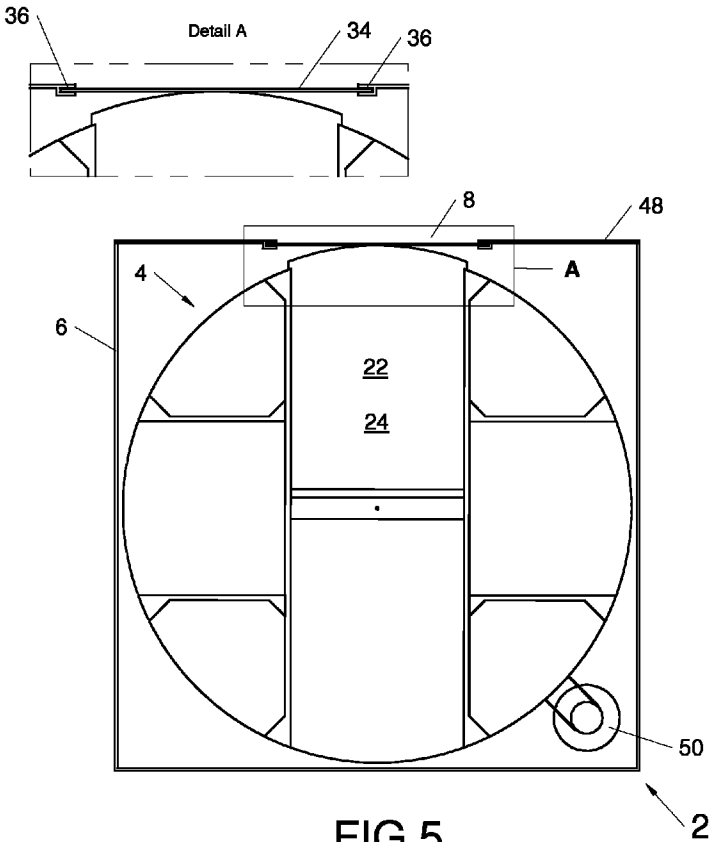

FIG. 5 reveals a removed schematic sectional view of the storage machine of FIG. 1 further comprising a rotatable storage cylinder showing a shelf partially removed but blocked from full removal by a door.

Figure 6:
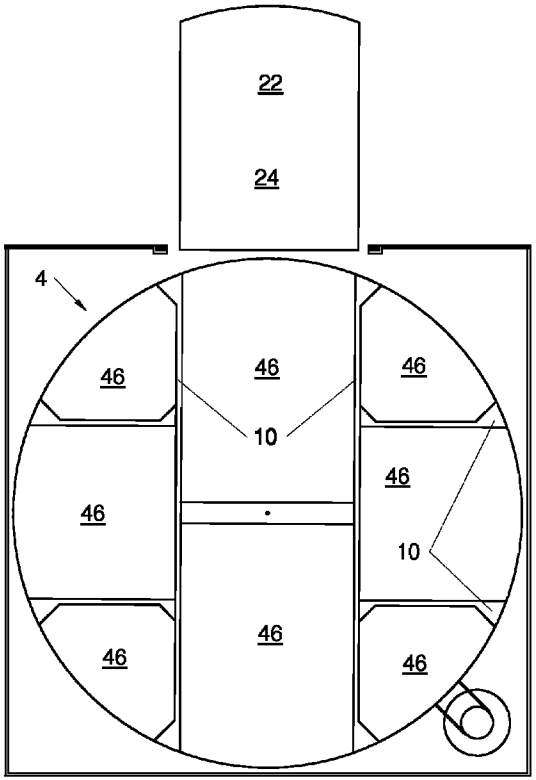

FIG. 6 reveals a removed schematic sectional view of the storage machine of FIG. 5 showing a shelf fully removed.

Figure 7:
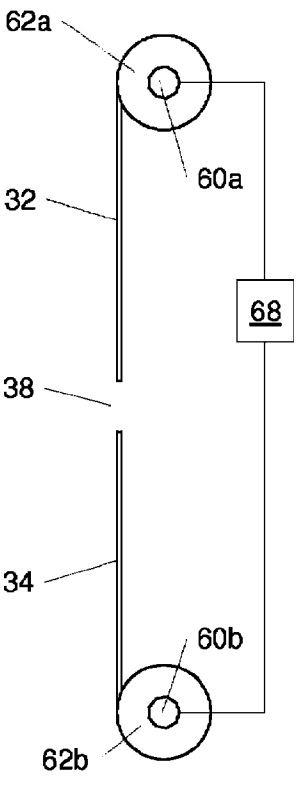

FIG. 7 shows a detail illustration of an embodiment with upper and lower doors using two drive mechanisms.

Figure 8:
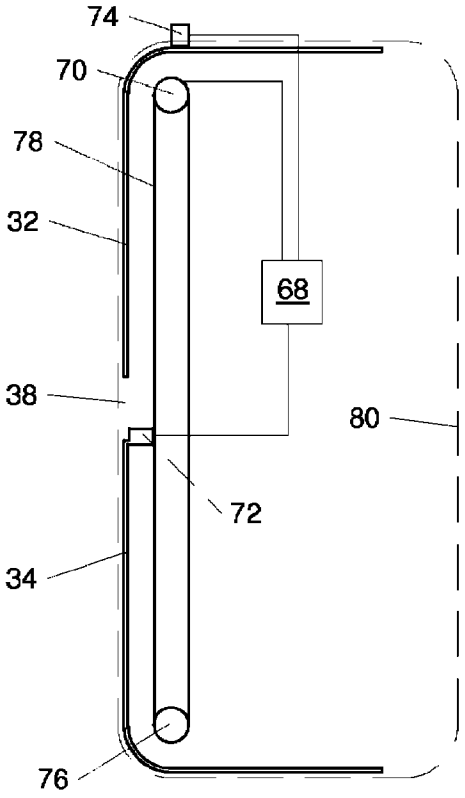

FIG. 8 shows a detail illustration of an embodiment with upper and lower doors using one drive mechanism and two latches and with the doors in an open position.

Figure 9:
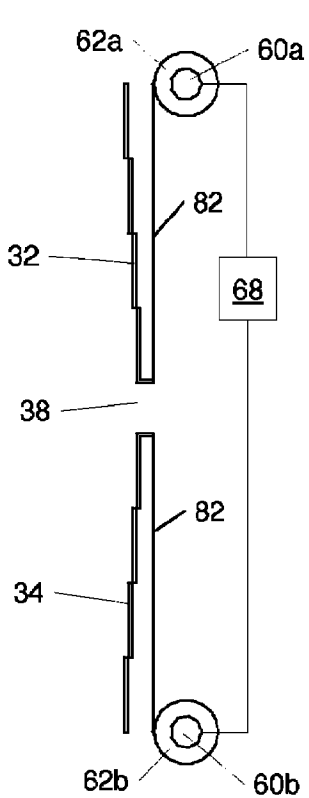

FIG. 9 shows a detail illustration of another embodiment with upper and lower doors configured as telescopic metal plates.

| DRAWINGS - REFERENCE NUMERALS: | |
|---|---|
| 2 | storage machine |
| 4 | storage cylinder |
| 6 | enclosure |
| 8 | enclosure opening |
| 10 | shelf support |
| 14 | shelf attachment means |
| 22 | shelf |
| 24 | load-bearing surface |
| 32 | upper door |
| 34 | lower door |
| 36 | door track |
| 38 | access opening |
| 44 | storage area |
| 46 | shelf stack |
| 48 | front enclosure panel |
| 50 | cylinder drive unit |
| 60a | upper drive unit |
| 60b | lower drive unit |
| 62a | upper winding mechanism |
| 62b | lower winding mechanism |
| 68 | controller |
| 70 | drive unit |
| 72 | moving latch |
| 74 | fixed latch |
| 76 | idler |
| 78 | drive belt |
| 80 | curved track |
| 82 | conveying mechanism |

DETAILED DESCRIPTION

FIG. 1 depicts a perspective view of storage machine 2 comprising shelf stack 46 (FIG. 4), an enclosure 6, and doors 32, 34. The shelf stack 46 further comprises a shelf support 10, shelf attachment means 14 and shelves 22. The enclosure 6 further comprises a front enclosure panel 48. The front enclosure panel 48 has a rectangular vertically oriented enclosure opening 8 and two door tracks 36 (FIG. 5) mounted opposite each other along the two vertical edges of the enclosure opening 8. Either upper 32 or lower door 34 can be positioned anywhere along the entire length of the enclosure opening 8. The upper door 32 and lower door 34 oppose each other and move vertically in door tracks 36. Moreover, doors 32, 34 may be independently positioned to allow an access opening 38 to form between them, providing openings that vary in height to access items of various vertical dimensions. The doors may consist of flexible material so that they may follow a curved track 80 (FIG. 8) around the top and bottom of the enclosure 6. Alternatively, the doors 32, 34 can roll up on winding mechanisms 62*a*, 62*b* (FIG. 7). The winding mechanisms 62*a*, 62*b* along with drive units 60*a*, 60*b* and controller 68 control the position of the upper and lower doors 32, 34 (FIG. 7). As shown in FIG. 1, a shelf stack 46 may be mounted in a fixed position inside the enclosure 6 and behind enclosure opening 8, or, as in another embodiment, may be part of a storage cylinder 4 (FIG. 5) that is rotatably mounted within enclosure 6.

Figure 2:
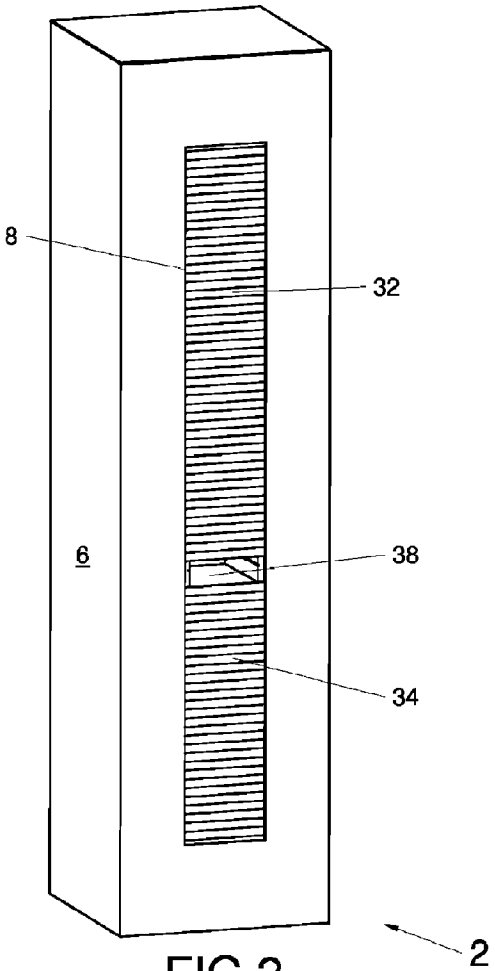
FIG. 2 shows a schematic perspective view of the storage machine with the doors in an open position allowing access to a storage area with small vertical height.

FIG. 2 shows the machine of FIG. 1 where both the upper and lower doors 32, 34 have moved to lower positions along enclosure opening 8, but here, the upper door 32 has moved further than the lower door 34 creating a smaller access opening 38. FIG. 2 illustrates how the independently positionable doors can form access openings 38 at selected vertical positions and with selected vertical size.

Figure 3:
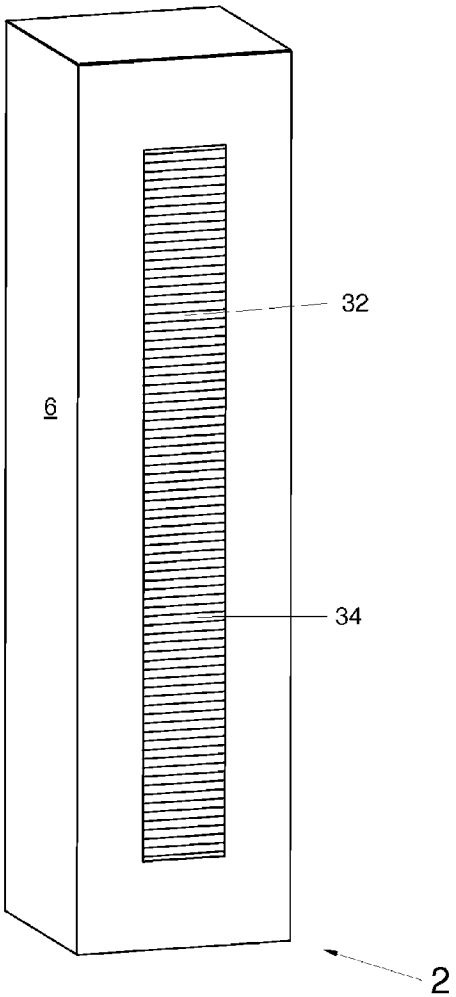
FIG. 3 shows a schematic perspective view of the storage machine with the doors in a closed position.

FIG. 3 shows the storage machine of FIG. 1 with the upper and lower doors 32, 34 in a closed position fully blocking the enclosure opening 8. Doors 32, 34 now block all access to items stored in machine 2.

Figure 4:
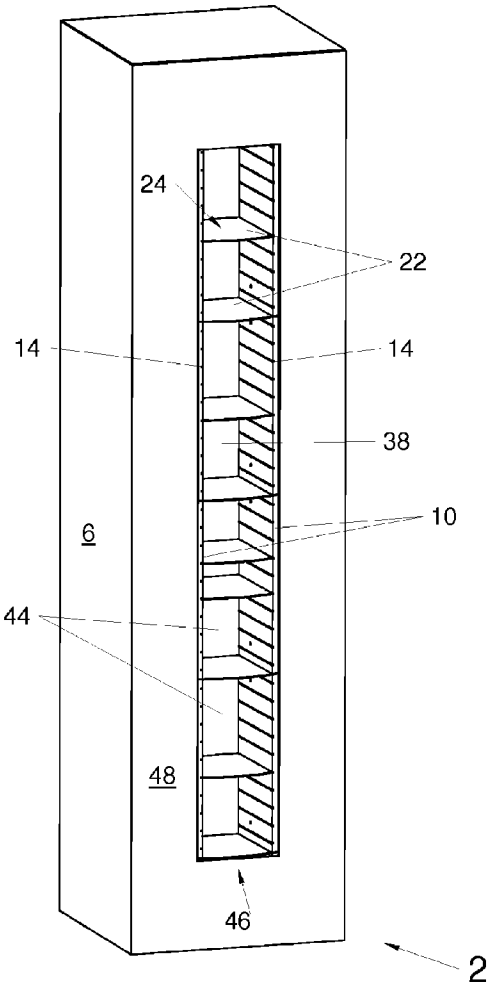
FIG. 4 shows a schematic perspective view of the storage machine with the doors in a fully open position allowing all shelves to be removed or inserted.

FIG. 4 shows the storage machine of FIG. 1 with the doors fully open. Here, the upper door 32 has moved to its topmost position and the lower door 34 to its bottommost position. Now, because shelf stack 46 is proximal to and aligned with enclosure opening 8, one has full access to shelf stack 46 and all of its storage areas 44 formed between shelves 22. Each shelf 22 is held in place along two opposite edges by shelf supports 10 and attachment means 14, and each shelf 22 has a load-bearing surface 24, which is generally but not necessarily horizontal.

Shelves 22 have a width and depth, and all shelves 22 of a shelf stack 46 have load-bearing surfaces 24 with corresponding edges that align vertically. Shelf supports 10 have corresponding parallel attachment means 14 that are aligned horizontally, allowing one to remove/install the drawer-style storage shelves 22 from shelf stack 46 by moving them horizontally through enclosure opening 8. As best seen in FIG. 6, the width of shelf 22 is smaller than the width of enclosure opening 8. Therefore, when not blocked by doors 32, 34, one can remove a shelf 22 from one vertical level of the shelf stack 46 and reinsert it at another level. In this way, one may change the height of storage area 44. (The height of the storage area 44 is simply the distance between the load-bearing surface 24 of one shelf 22 and the bottom surface of the shelf above it.) Of course, if doors 32, 34 are not in a fully open position, one can still reposition any subset of shelves 22 that are not blocked. The load-bearing surface 24 does not have to be planar and may be shaped to accommodate the stored items.

FIGS. 5 and 6 show a schematic sectional view of another embodiment of storage machine 2, comprising an enclosure 6, multiple shelf stacks 46, two door tracks 36, and doors 32, 34. Both doors 32 and 34 move vertically in tracks 36. In this embodiment, multiple shelf stacks 46 form storage cylinder 4. A cylinder drive unit 50 rotates cylinder 4 within enclosure 6. When cylinder 4 rotates, any one of the shelf stacks 46 can be positioned directly behind and aligned with enclosure opening 8. Shelf supports 10 divide cylinder 4 into shelf stacks 46 such that each stack has a pair of shelf supports 10 supporting shelves 22. Because shelves 22 are narrower than enclosure opening 8 (best seen in FIG. 6), when a shelf stack 46 is directly behind and aligned with enclosure opening 8, one may remove and insert the shelves 22 through enclosure opening 8. Shelves 22 divide each shelf stack 46 into multiple storage areas 44 (FIG. 4). The shelf supports 10 have attachment means 14 (shown as horizontal slots in FIG. 4) to allow easy repositioning of the shelves 22. In this embodiment, the doors 32, 34 provide access to many more storage areas than would be possible with a fixed-position shelf stack.

FIG. 7 provides a detail illustration of an embodiment where controller 68, drive units 60*a*, 60*b*, and winding mechanisms 62*a*, 62*b* independently control the positions of the upper and lower doors 32, 34.

FIG. 8 shows another embodiment of the storage machine. Here, a single drive unit 70, drive belt 78, and idler 76, in conjunction with two latching mechanisms 72, 74 and controller 68, control the positions of the upper and lower doors 32, 34. When doors 32, 34 are closed (as shown in FIG. 3), the moving latch 72 locks the two doors 32, 34 together. Drive unit 70 positions both doors 32, 34 so that the upper door 32 aligns with the upper boundary of a storage area 44 (FIG. 1). Then, fixed latch 74 locks upper door 32 in place. The moving latch 72 unlatches lower door 34 from upper door 32, and the drive unit 70 moves lower door 34 to the lower boundary of storage area 44. Now, doors 32, 34 form an access opening 38 (as shown in FIG. 8 and FIG. 1), to storage area 44.

FIG. 9 shows another embodiment of the storage machine where doors 32, 34 resemble telescopic plates. This embodiment further comprises a conveying mechanism 82, which in conjunction with winding mechanisms 62*a*, 62*b*, drive units 60*a*, 60*b*, and controller 68, independently position doors 32, 34.

Operation

The embodiments of these machines have two modes of operation: (1) the dispense/return mode, which allows users to either take or return items, and (2) the restock/reconfigure mode, which allows the administrator to restock or reconfigure the shelving.

In the dispense/return mode, the user requests a stored item. For the embodiment with cylinder 4, storage cylinder 4 rotates until the shelf stack 46 containing the item is positioned behind the enclosure opening 8. For all embodiments, doors 32, 34 move to allow access to the storage area 44 assigned to the item. In this mode, doors 32, 34 block the removal of shelves 22. The positions of the doors shown in FIGS. 1, 2, and 5 reveal examples of the dispense/return mode. As can be most clearly seen in FIG. 5, shelf 22 cannot be removed; but, as best shown in FIG. 1, the storage area 44 above shelf 22 is open to the user. After the user removes/returns an item from/to storage area 44, doors 32, 34 return to their closed position. The doors remain closed until the user requests another item.

FIGS. 4 and 6 show the machine in the restock/reconfigure mode. The upper door 32 has moved to its topmost position and the lower door 34 to its bottommost position. Neither door blocks any part of access opening 8. Here, all storage areas of a shelf stack 46 are available for easy restocking. In addition, the doors 32, 34 do not block the removal of any of the shelves 22 (best shown in FIG. 6). Thus, by removing or reinserting shelves 22 at other vertical positions, one maximizes space utilization by adjusting the height of the storage areas 44 to the height of the stored items. Although FIG. 4 shows the doors in a fully open position, FIG. 6 reveals that one can remove or reinsert the shelves 22 any time the upper and lower doors 32, 34 do not block shelf removal. Therefore, one can also restock or reconfigure the machine with the doors partially opened.

CONCLUSION, RAMIFICATIONS, AND SCOPE

This storage machine uses independently positionable doors to create a variable-height access opening 38 to provide easy, secure access to stored objects. This storage machine allows one to access items stored at different vertical elevations and accommodates objects of different heights without wasting valuable storage space. While valuable when used with a fixed-position shelf stack 46, this machine offers further advantages when one groups the shelf stacks 46 to form a storage cylinder 4. In either embodiment, the machine allows one to easily reposition the shelves 22 during restock/reconfigure operations without the use of tools (or with readily available tools) and without opening the enclosure. Further, during the dispense/return mode, this design insures that shelving 22 cannot be adjusted or removed.

This design may also incorporate machines containing nested rotating platters. In these machines, several rotating storage cylinders 4 sit on a larger rotating platter to bring any one of a number of different rotating cylinders to the enclosure opening. In some cases, these larger platters are mounted on yet a larger (main) platter to greatly increase the number of storage cylinders brought to the enclosure opening. The main platter, large platter, and storage cylinder rotate simultaneously to rapidly bring any one of the shelf stacks to the enclosure opening 8.

I claim:

1. A storage and retrieval machine comprising:

a) an enclosure where said enclosure has a front enclosure panel and where a portion of said front enclosure panel comprises an enclosure opening where said enclosure opening has a fixed position and a fixed width and is generally rectangular in shape and has a height dimension that is greater than its width dimension;

b) a shelf stack further comprising a plurality of shelves, at least one shelf support, and a plurality of shelf attachment means where said shelf stack is located inside said enclosure and where each said shelf of said plurality of shelves has at least one load-bearing surface and is supported by said at least one shelf support using at least one of said plurality of shelf attachment means where corresponding edges of said at least one load-bearing surfaces are vertically aligned and where storage areas are formed by the vertical space between said plurality of shelves and where said plurality of shelf attachment means allow for the removal and insertion of said plurality of shelves, and further, where said shelf stack is proximal to and aligned with said enclosure opening and where said shelf stack has approximately the same width as said enclosure opening whereby said enclosure opening allows access to said shelf stack and said front enclosure panel blocks access to other parts of said enclosure;

c) two independently positionable doors at said enclosure opening arranged opposite each other such that said two independently positionable doors can be moved vertically to form an access opening at any selected position and any selected vertical size along said enclosure opening and where one of said two independently positionable doors is an upper door and another is a lower door;

d) a multiplicity of said shelf stacks grouped to form at least one storage cylinder that is rotatably mounted inside said enclosure such that when rotated all shelf stacks can be brought to a position proximal to and aligned with said enclosure opening whereby said storage areas and said shelves are accessible through any part of said enclosure opening not blocked by said two independently positionable doors.

2. The storage and retrieval machine of claim 1 wherein said shelf stack comprises a first shelf support and a second shelf support wherein said second shelf support has corresponding attachment means parallel to said shelf attachment means of said first shelf support and whereby said plurality of shelves are supported along two edges.

3. The storage and retrieval machine of claim 1 where both said upper door and said lower door can independently travel approximately the full length of said enclosure opening whereby the enclosure opening can be fully blocked when said upper and said lower doors are in a closed position and fully accessible when said upper and said lower doors are in a fully open position.

4. The storage and retrieval machine of claim 1 wherein said upper door has a stiff lower edge and a flexible portion above said stiff lower edge and said lower door has a stiff upper edge and a flexible portion below said stiff upper edge whereby said flexible portions can travel along a curved track inside said enclosure and said stiff edges better ensure that access into said enclosure is limited to said access opening.

5. The storage and retrieval machine of claim 1 wherein each said door further comprises a drive unit connected to a controller whereby each door can be independently positioned.

6. The storage and retrieval machine of claim 1 further comprising a fixed latch and a moving latch where said upper door and said lower door are controlled by a single drive unit and where said moving latch latches said upper and said lower doors together so that said drive unit may move both doors simultaneously to a point along said enclosure opening and where said moving latch then unlatches said upper door from said lower door and where said upper door is secured to said enclosure by said fixed latch so that said drive unit can move said lower door independently of said upper door to form said access opening.

7. The storage and retrieval machine of claim 1 where said shelf attachment means allow for removal and insertion of said shelves through said enclosure opening by approximately horizontal motion of said shelves.

8. The storage and retrieval machine of claim 1 wherein said two independently positionable doors are moved by a drive unit.

9. A storage and retrieval machine comprising:

a) an enclosure where said enclosure has an enclosure opening;

b) a shelf stack further comprising a plurality of shelves, at least one shelf support, and a plurality of shelf attachment means where said shelf stack is located inside said enclosure and where each said shelf of said plurality of shelves has at least one load-bearing surface and is supported by said at least one shelf support using at least one of said plurality of shelf attachment means where corresponding edges of at least one said load-bearing surfaces are vertically aligned and where storage areas are formed by the vertical space between said plurality of shelves, and further, where said shelf stack is proximal to and aligned with said enclosure opening;

c) a drive unit;

d) an upper door and a lower door at said enclosure opening arranged opposite each other where said doors are independently positionable and can be moved vertically to form an access opening at any selected position and of any selected vertical size along said enclosure opening and where said upper and lower doors are flexible whereby they can travel along a curved track inside said enclosure;

e) a fixed latch and a moving latch where said upper door and said lower door are controlled by a single drive unit and where said moving latch latches said upper and said lower doors together so that said drive unit may move both doors simultaneously to a point along said enclosure opening and where said moving latch then unlatches said upper door from said lower door and where said upper door is secured to said enclosure by said fixed latch so that said drive unit can move said lower door independently of said upper door to form said access opening.

10. The storage and retrieval machine of claim 9 wherein said shelf stack comprises a first shelf support and a second shelf support wherein said second shelf support has corresponding attachment means parallel to said shelf attachment means of said first shelf support and whereby said plurality of shelves are supported along two edges.

11. The storage and retrieval machine of claim 9 further comprising a multiplicity of said shelf stacks grouped to form a storage cylinder that is rotatably mounted inside said enclosure such that when rotated all shelf stacks can be brought to a position proximal to and aligned with said enclosure opening whereby said storage areas and said shelves are accessible through any part of said enclosure opening not blocked by said two independently positionable doors.

12. The storage and retrieval machine of claim 9 where both said upper door and said lower door can independently travel approximately the full length of said enclosure opening whereby the enclosure opening can be fully blocked when said upper and said lower doors are in a closed position and fully accessible when said upper and said lower doors are in a fully open position.

13. The storage and retrieval machine of claim 9 where said shelf attachment means allow for removal and insertion of said shelves through said enclosure opening by approximately horizontal motion of said shelves.

* * * * *